US008569607B1

(12) United States Patent
Branzburg

(10) Patent No.: US 8,569,607 B1
(45) Date of Patent: Oct. 29, 2013

(54) METHOD AND REFERENCE BEAT TIME TEMPLATE GENERATING APPARATUS FOR EQUAL TEMPERAMENT TUNING A PIANO

(76) Inventor: Mihail Branzburg, Kingston, NY (US)

( * ) Notice: Subject to any disclaimer, the term of this patent is extended or adjusted under 35 U.S.C. 154(b) by 0 days.

(21) Appl. No.: 13/563,968

(22) Filed: Aug. 1, 2012

(51) Int. Cl.
*G10H 5/00* (2006.01)
*G10G 7/02* (2006.01)

(52) U.S. Cl.
USPC ..... 84/654; 84/455

(58) Field of Classification Search
USPC ..... 84/616, 654, 454, 455
See application file for complete search history.

(56) References Cited

U.S. PATENT DOCUMENTS

| | | | | | |
|---|---|---|---|---|---|
| 3,968,719 | A | * | 7/1976 | Sanderson | 84/454 |
| 4,041,831 | A | * | 8/1977 | Arpino | 84/454 |
| 4,253,374 | A | * | 3/1981 | Watterman | 84/455 |
| 4,523,506 | A | * | 6/1985 | Hollimon | 84/454 |
| 5,285,711 | A | | 2/1994 | Sanderson | |
| 5,773,737 | A | * | 6/1998 | Reyburn | 84/454 |
| 5,814,748 | A | * | 9/1998 | Reyburn | 84/454 |
| 5,877,443 | A | * | 3/1999 | Arends et al. | 84/454 |
| 5,929,358 | A | * | 7/1999 | Reyburn | 84/454 |

OTHER PUBLICATIONS

"Piano tuning" from Wikipedia, the free encyclopedia at www.en.wikipedia.org/wiki/ found May 16, 2012.
"The Well-Tempered Clavier" from Wikipedia, the free encyclopedia at http://en.wikipedia.org/wiki/Well-Tempered_Clavier, found Jan. 16, 2013 10:37 AM.
"Equal temperament—History" as Encyclopedia II | Global Oneness at http://www.experiencefestival.com/a/Equal_temperament_-_History/id/5548347 found Jan. 16, 2013 10:53 AM.

* cited by examiner

*Primary Examiner* — Jeffrey Donels
(74) *Attorney, Agent, or Firm* — BK Patents, Inc; Billy J. Knowles

(57) ABSTRACT

A method and apparatus that enables tuning a piano to exact equal temperament includes beat time template generator. The beat time template generator is provided a fundamental key describing the fixed pitch the reference key is tuned and a secondary key to be tuned. The beat time template generator determines all the harmonics of the fundamental key and the secondary key. A difference beat frequency for all the harmonics is calculated for the fundamental key and secondary key and one beat time is selected as a reference beat time template signal. The reference beat time template signal is then transferred to a speaker for reproduction. A piano tuner then adjusts the strings of the secondary key such that when the fundamental key and the secondary key are struck simultaneously, the beat time of the struck keys is identical to the reference beat time template signal from the beat time template generator.

19 Claims, 8 Drawing Sheets

*12th ROOT OF 2 EQUALS 1.0594631*

HARMONICS
(THEORETICALLY PERFECT PARTIALS)

| | Fundamental or 1st | 2nd | 3rd | 4th | 5th | 6th |
|---|---|---|---|---|---|---|
| F3 | 349.228 | 698.456 | 1047.684 | 1396.912 | 1746.140 | 2095.368 |
| E3 | 329.628 | 659.256 | 988.884 | 1318.512 | 1648.140 | 1977.768 |
| D#3/E♭3 | 311.127 | 622.254 | 933.381 | 1244.508 | 1555.635 | 1866.762 |
| D3 | 293.665 | 587.330 | 880.995 | 1174.660 | 1468.325 | 1761.990 |
| C#3/D♭3 | 277.183 | 554.366 | 831.549 | 1108.732 | 1385.915 | 1663.098 |
| C3 | 261.626 | 523.252 | 784.878 | 1046.504 | 1308.130 | 1569.756 |
| B2 | 246.942 | 493.884 | 740.826 | 987.768 | 1234.710 | 1481.652 |
| A#2/B♭2 | 233.082 | 466.164 | 699.246 | 932.328 | 1165.410 | 1398.492 |
| A2 | 220.000 | 440.000 | 660.000 | 880.000 | 1100.000 | 1320.000 |
| G#2/A♭2 | 207.652 | 415.304 | 622.956 | 830.608 | 1038.260 | 1245.912 |
| G2 | 195.998 | 391.996 | 587.994 | 783.992 | 979.990 | 1175.988 |
| F#2/G♭2 | 184.997 | 369.994 | 554.991 | 739.988 | 924.985 | 1109.982 |
| F2 | 174.614 | 349.228 | 523.842 | 698.456 | 873.070 | 1047.684 |

*Fig. 2*

| | F3 | E3 | D#3/E♭3 | D3 | C#3/D♭3 | C3 | B2 | A#2/B♭2 | A2 | G#2/A♭2 | G2 | F#2/G♭2 | F2 |
|---|---|---|---|---|---|---|---|---|---|---|---|---|---|
| F3 | | | | 7.925 | 5.498 | .59 | | .395 | | 4.712 | | | |
| E3 | | | | | 7.479 | 5.191 | .558 | | .372 | | 4.447 | | |
| D#3/E♭3 | | | | | | 7.06 | 4.899 | .526 | | .351 | | 4.198 | |
| D3 | | | | | | | 6.663 | 4.625 | .497 | | .332 | | 3.962 |
| C#3/D♭3 | | | | | | | | 6.288 | 4.366 | .470 | | .312 | |
| C3 | | | | | | | | | 5.935 | 4.122 | .443 | | .295 |
| B2 | | | | | | | | | | 5.601 | 3.889 | .419 | |
| A#2/B♭2 | | | | | | | | | | | 5.289 | 3.671 | .395 |
| A2 | | | | | | | | | | | | 4.991 | 3.465 |
| G#2/A♭2 | | | | | | | | | | | | | 4.172 |
| G2 | | | | | | | | | | | | | |
| F#2/G♭2 | | | | | | | | | | | | | |
| F2 | | | | | | | | | | | | | |

*Fig. 3a*

*Fig. 3b*

| | F3 | E3 | D#3/E♭3 | D3 | C#3/D♭3 | C3 | B2 | A#2/B♭2 | A2 | G#2/A♭2 | G2 | F#2/G♭2 | F2 |
|---|---|---|---|---|---|---|---|---|---|---|---|---|---|
| F3 | | | | 238<br>7.925 | 165<br>5.498 | .59 | | .395 | | 141<br>4.712 | | | |
| E3 | | | | | 224<br>7.479 | 156<br>5.191 | .558 | | .372 | | 133<br>4.447 | | |
| D#3/E♭3 | | | | | | 212<br>7.06 | 147<br>4.899 | .526 | | .351 | | 126<br>4.198 | |
| D3 | | | | | | | 200<br>6.663 | 139<br>4.625 | .497 | | .332 | | 114<br>3.962 |
| C#3/D♭3 | | | | | | | | 188<br>6.288 | 131<br>4.366 | .470 | | .312 | |
| C3 | | | | | | | | | 178<br>5.935 | 123<br>4.122 | .443 | | .295 |
| B2 | | | | | | | | | | 168<br>5.601 | 116<br>3.889 | .419 | |
| A#2/B♭2 | | | | | | | | | | | 158<br>5.289 | 110<br>3.671 | .395 |
| A2 | | | | | | | | | | | | 150<br>4.991 | 104<br>3.465 |
| G#2/A♭2 | | | | | | | | | | | | | 141<br>4.172 |
| G2 | | | | | | | | | | | | | |
| F#2/G♭2 | | | | | | | | | | | | | |
| F2 | | | | | | | | | | | | | |

| | $F_3$ | F#3/G♭3 | G3 | G#3/A♭3 | A3 | A#3/B♭3 | B3 | C4 | C#4/D♭4 | D4 | D#4/E♭4 | E4 | $F_4$ |
|---|---|---|---|---|---|---|---|---|---|---|---|---|---|
| $F_4$ | 0 | | | 9.424 | | .790 | | 1.180 | 10.997 | 15.850 | | | |
| E4 | | | 8.894 | | .744 | | 1.116 | 10.382 | 14.958 | | | | |
| D#4/E♭4 | | 8.396 | | .702 | | 1.053 | 9.798 | 14.121 | | | | | |
| D4 | 7.925 | | .664 | | .995 | 9.250 | 13.327 | | | | | | |
| C#4/D♭4 | | .625 | | .941 | 8.732 | 12.577 | | | | | | | |
| C4 | .590 | | .886 | 8.244 | 11.870 | | | | | | | | |
| B3 | | .838 | 7.778 | 11.202 | | | | | | | | | |
| A#3/B♭3 | .790 | 7.343 | 10.578 | | | | | | | | | | |
| A3 | 6.930 | 9.982 | | | | | | | | | | | |
| G#3/A♭3 | 9.424 | | | | | | | | | | | | |

*Fig. 4*

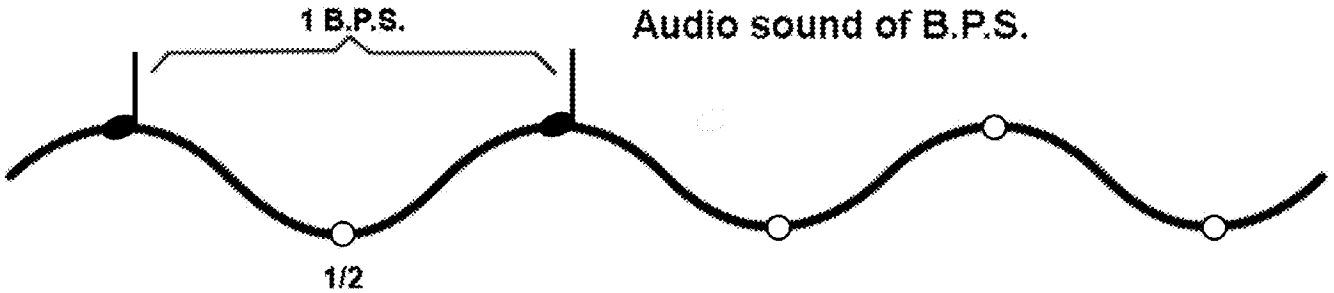
Fig. 5a
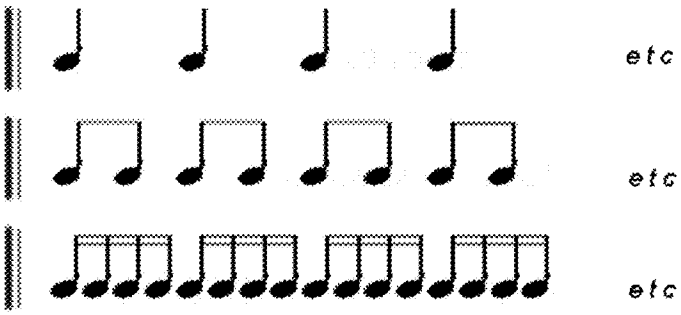
Fig. 5b ♩ = 416 B.P.M. then
Fig. 5c ♩ = 208 B.P.M. then
Fig. 5d ♩ = 104 B.P.M. then

METHOD AND REFERENCE BEAT TIME TEMPLATE GENERATING APPARATUS FOR EQUAL TEMPERAMENT TUNING A PIANO

TECHNICAL FIELD

This disclosure relates generally to methods and apparatus for tuning musical instruments. More particularly, this disclosure relates to methods and apparatus for equal temperament tuning of pianos and other similar instruments.

BACKGROUND

As is known, the keys of a piano are divided into seven groups or octaves. Each octave has twelve keys that are tuned with equal temperament. Equal temperament tuning is a method of tuning each of the notes within each octave such that every pair of adjacent notes has an identical frequency ratio. Pitch is perceived roughly as the logarithm of frequency by the human ear and thus the perceived "distance" from every note to its nearest neighbor is equal to a ratio of the logarithms of frequencies of the adjacent keys. Each frequency for each key of a piano is determined by the equation:

$$f(N) = f(M) * \left(2^{\left(\frac{N-M}{12}\right)}\right)$$

Where:

f(N) is the frequency of the $N^{th}$ key of the piano keyboard.

N is the numbering of the keys of the piano with the farthest left key being N=0.

f(M) is the frequency of a key tuned to a standard pitch.

M is the key number of the key tuned to the standard pitch. Usually the standard pitch or frequency is the A key above middle C or $A_4$. M=49 for the key $A_4$.

The history of the evolution of equal temperament is divided into two parts, before and after invention of equal temperament formula. First recorded date of the development of the concept of equal temperament is 1584 by Chu Tsai-Yu of the Ming Dynasty. Then European mathematicians Simon Stevin (1585) and Marin Mersenne (1636) developed their versions of equal temperament. Before equal temperament, it was a struggle to find some kind of universal system for tuning a musical instrument After introduction of the equal temperament concept, it was about 300 years before it was finally accepted for use in a few selected countries. It was assumed that J. S. Bach had intended equal temperament in his "Well-Temperd Clavier". However, there is a difference between "well tempered" and "equal temperament". The evolution of equal temperament still took decades for it to be permanently adopted by the musicians. In 1939, the standard pitch or frequency of the A key above middle C or $A_4$ as 440 Hz was adopted.

FIG. 1 is a diagram of a piano keyboard showing the designations for each of the keys of the keyboard. To tune a piano minute adjustments are made to the tensions of the strings of a piano to properly align the intervals between their tones so that the instrument is in tune. In the context of piano tuning, being in tune is not simply setting the tensions of the strings of the piano to a set of assigned frequencies or pitches. A piano tuner must assess the interaction between the notes. The tuner will tune one of the keys to a standard pitch or frequency such as the "A" key above middle "C" or "$A_4$" that is tuned to a frequency of 440 Hz. The remaining keys are tuned in relationship to the chosen fixed pitch (i.e. "$A_4$"=440 Hz).

SUMMARY

An object of this disclosure is to provide an exact equal temperament tuning method and apparatus.

To accomplish at least this object, a beat time template generator is provided a fundamental key describing the fixed pitch that a key is tuned and a secondary key that is to be tuned. The beat time template generator determines all the harmonics of the fundamental key and the secondary key. A difference beat time is determined for all the harmonics calculated for the fundamental key and secondary key and one beat time is selected as a reference beat time template signal. The reference beat time template signal is then transferred to a speaker for reproduction. A piano tuner then adjusts the strings of the secondary key such that when the fundamental key and the secondary key are struck simultaneously, the beat time of the struck keys is identical to the reference beat time template signal from the beat time template generator.

The beat time template generator includes a control interface device such as a display and a keyboard, a touch sensitive display, or a panel including indicator lights and switches. The beat time template generator has a fundamental note selector for indicating which note of the piano is tuned to an accurate pitch or frequency. A secondary note selector indicates the note of the piano that is to be tuned relative to the fundamental note. The control interface device has a fundamental note register and a secondary note register to respectively receive and retain a digital code indicative of the frequency or pitch of the fundamental note and the secondary note.

The beat time template generator has a fundamental note harmonic generator connected to the fundamental note register to receive the digital code of the fundamental note and to generate a set of digital codes indicative of a set of the harmonics of the frequency of the fundamental note. The secondary note register is connected to a secondary note harmonic generator to receive the digital code of the secondary note and to generate a set of digital codes indicative of a set of the harmonics of the frequency of the secondary note. In some embodiments, there are six harmonic frequencies included in each set of harmonics of the fundamental note and the secondary note.

The harmonic codes for the fundamental note and the harmonic codes for the secondary note are transferred to a beat time calculator. The beat time calculator determines all the combinations of beat times as a difference between the fundamental note and its harmonics and the secondary note and its harmonics to generate a set of all the beat time codes. In various embodiments, the beat time is transferred to the control interface device where the numerical frequencies represented by the beat time codes are displayed.

A beat time selector is connected to the beat time calculator to receive the beat time codes. In some embodiments, the piano tuner selects the desired beat time and the beat time select signal chooses the selected beat time code. In other embodiments, the beat time code that is an inverse of a number of beats per second (BPS) is chosen automatically.

A digital to analog converter is connected to the beat time selector to receive the digital code representing the selected beat time template between the fundamental note and the secondary note. The digital to analog converter generates an electrical signal that is transferred to a speaker for reproduction of the beat time template. The piano tuner then strikes the fundamental note and the secondary note simultaneously. The piano tuner detects the difference between the beat time of the simultaneously struck fundamental note and the secondary note and the reproduced beat time template from the speaker of the beat time template generator. The piano tuner then adjusts the string of the secondary note until beat time of the simultaneously struck fundamental note and the secondary note is identical to the beat time template of the beat time template generator.

In various embodiments, a method for tuning a piano begins with tuning a fundamental note such as the "A" key above middle "C" or "$A_4$"=440 Hz. A secondary note is chosen for tuning and the harmonics for the fundamental note and the secondary note are determined. In some embodiments, six harmonics are determined for the fundamental note and the secondary note. The beat times are determined for all combinations of the harmonics of the fundamental frequency and the secondary frequency. The desired beat time is chosen. In other embodiments, the beat time is chosen automatically. The chosen beat time is generated and reproduced through a speaker.

The piano tuner then strikes the fundamental note and the secondary note simultaneously. The piano tuner detects the difference between the beat time of the simultaneously struck fundamental note and the secondary note and the reproduced beat time from the speaker. The piano tuner then adjusts the string of the secondary note until beat time of the simultaneously struck fundamental note and the secondary note is identical to the beat time template of the beat time template generator.

The piano tuner then selects another secondary note for tuning, determines the beat time rate and generates the beat time template for reproduction. The piano tuner then adjusts the tension of the string of the secondary note until the beat time of the simultaneously struck fundamental note and the secondary note is identical to the beat time template of the beat time template generator. When all notes of the piano are tuned the method is complete.

BRIEF DESCRIPTION OF THE DRAWINGS

FIG. 2 is a chart of the harmonic frequencies for the notes of the octave from the second "F" Key ($F_2$) to third F" Key ($F_3$).

FIG. 3*a* is a chart of the beat frequencies between the pitch or frequencies of any two notes of the octave from the second "F" Key ($F_2$) to third F" Key ($F_3$) in beats per second.

FIG. 3*b* is a chart of the beat frequencies between the pitch or frequencies of any two notes of the octave from the second "F" Key ($F_2$) to third F" Key ($F_3$) in beats per second and beats per minute.

FIG. 4 is a chart of the beat frequencies between the pitch or frequencies of any two notes of the octave from the third "F" Key ($F_3$) to fourth F" Key ($F_4$) in beats per second.

FIG. 5*a* is a waveform illustrating a beat per second for an audio signal.

FIGS. 5*b*-5*d* is the musical symbology for the beat structure for harmonic frequencies of a metronome.

DETAILED DESCRIPTION

Figure 1:
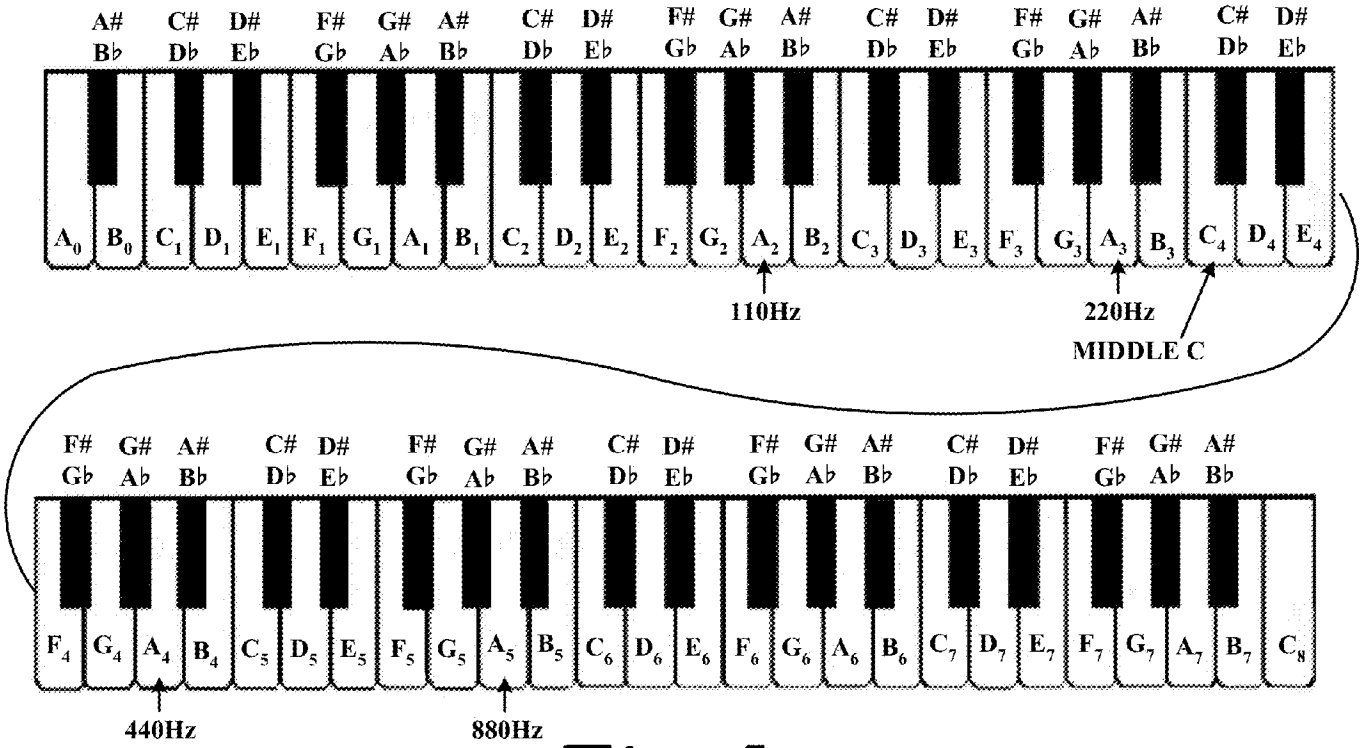
Fig. 1 Prior Art
FIG. 1 is a diagram of a piano keyboard showing the designations for each of the keys of the keyboard.

In tuning a piano, a key is tuned to a fundamental frequency. In most cases, the initial key that is tuned is the "A" key above middle "C" or "$A_4$" is tuned to a pitch or frequency of 440 Hz. This is identified as a fixed pitch and provides the fundamental frequency. The secondary key(s) to be tuned is tuned relative to the pitch of the $A_4$ Key. The $A_4$ key and the secondary key that is being tuned are struck simultaneously. The notes will sound with the fundamental notes and their harmonics. Each or the harmonics will additively or subtractively combine to form a beat frequency. The second key is adjusted such that the relationships of the frequency between the fixed pitch key with its harmonics and the second key with its harmonics have the correct beat frequencies. If the beat frequencies are not correct, the piano is not tuned to be in equal temperament.

FIG. 2 is a chart of the harmonic frequencies for the notes of the octave from the second "F" Key ($F_2$) to third F" Key ($F_3$). It can be shown that each of the keys have an equal logarithmic between each of their frequencies. FIG. 3*a* is a chart of the beat frequencies between the pitch or frequencies of any two notes of the octave from the second "F" Key ($F_2$) to third "F" Key ($F_3$) in beats per second. The chart is read by picking a frequency on one horizontal row and picking a second frequency on one vertical column. The beat frequency is chosen as the smallest difference between the pitch of the first key and its harmonics and the pitch of the second key and its harmonics. For example, the beat frequency between the second "F" Key ($F_2$) and the second "A" key $A_2$ is 3.465 BPS. The beat frequency is the result of combining the $4^{th}$ harmonic of the $A_2$ key and the $5^{th}$ harmonic of the $F_2$ key.

FIG. 3*b* is a chart of the beat frequencies between the pitch or frequencies of any two notes of the octave from the second "F" Key ($F_2$) to third F" Key ($F_3$) in beats per second and beats per minute. As is known, metronomic notation is standardized in beats per minute. Therefore, the beats per second for the beat frequencies are multiplied by 60 to designate the beats per minute. For example, the beat frequency between the $F_2$ key and the $A_2$ key is 3.465 BPS, as noted above. That translates to 104 beats per minute (BPM).

FIG. 4 is a chart of the beat frequencies between the pitch or frequencies of any two notes of the octave from the third "F" Key ($F_3$) to fourth F" Key ($F_4$) in beats per second. As can be seen, when FIGS. 3*a* and 4 are compared, the beat frequencies in the octave between the $F_3$ key and the $F_4$ key are double the beat frequencies of the octave between the $F_2$ key and the $F_3$. For example, the frequency of beat frequency discussed above between the $F_2$ key and the $A_2$ key is 3.465 BPS and the beat frequency between the $F_3$ key and the $A_3$ key is 6.930 BPS.

FIG. 5*a* is a waveform illustrating a one beat per second wave for an audio signal and FIGS. 5*b*-5*d* is the musical symbology for the beat structure for harmonic frequencies of a metronome. As is known, the fundamental wave structure or a pure tone for sound is a sine wave. If the time from one peak of a sine wave to a second peak of the sine wave is one second, the wave is said to have a frequency of 1 Hz. A metronome will make a sound at the time of each peak or one beat per second that is a setting of sixty beats per minute for the metronome. The universal symbol for a metronome beat is the quarter note (♩) and indicative of the number of notes played or beats of the metronome. To replicate the beat frequency of the between the $F_3$ key and the $A_3$ key that is 6.93 BPS or 416 BPM, the metronome is set such that quarter note (♩) equals 416 BPM as shown in FIG. 5*b*. Alternately, the metronome may be set to 208 BPM. Then the beat frequency of the between the $F_3$ key and the $A_3$ key must occur twice during the metronome period as shown in FIG. 5*c*. In FIG. 5*d*, the metronome is set to a frequency of 104 BPM. In this case the beat frequency of the between the $F_3$ key and the $A_3$ key occurs four times in the period of the metronome beat.

Figure 6:
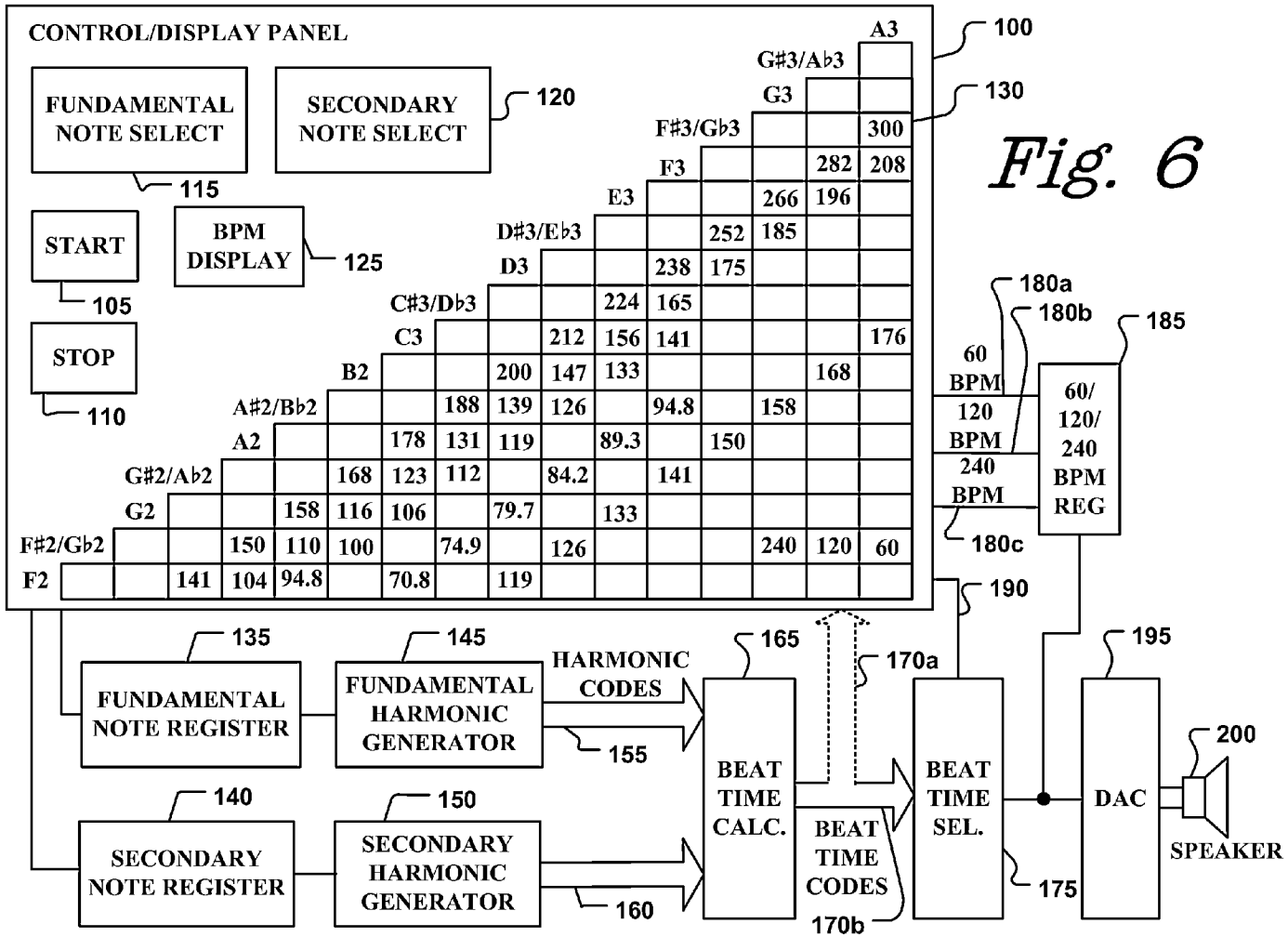
FIG. 6 is a block diagram of a beat time template generator embodying the principles of this disclosure.

FIG. 6 is a block diagram of a beat time template generator embodying the principles of this disclosure. The beat time template generator has a control/display panel 100 that includes start switch 105 and stop switch 110 for activating and deactivating the beat time template generator. The beat time template generator has a fundamental note selector 115 that in some embodiments is a selector switch with a display to show indicate the fundamental note. Similarly, the beat time template generator has a secondary note selector 115 that in some embodiments is a selector switch with a display to show indicate the secondary note to be tuned.

In some embodiments, a beats per minute display 125 is a media display device that is a light emitting diode (LED) or liquid crystal (LCD) matrix or seven segment display for displaying the calculated beat frequency for the fundamental note and the secondary note. In other embodiments, the control display panel 100 is a media display device such as a touch screen or computer monitor. In embodiments, where the control display panel 100 is a media display device, the start switch 105, the stop switch 110, the fundamental note selector 115 and the secondary note selector 120 are incorporated in the media display device. The beat frequency chart 130 shows a set of the keys that are to be tuned. In the illustration, the beat frequency chart 130 has the notes between the $F_2$ key and the $A_3$ key. The fundamental note selector 115 and the secondary note selector 120 are incorporated in the displayed beat frequency chart 130. In a touch screen or a screen with a mouse/cursor selection mechanism as in a computer system, the notes between the $F_2$ key and the $A_3$ key are sensitive to selection and function as the fundamental note selector 115 and the secondary note selector 120.

The control/display panel 100 is connected to the fundamental note register 135 and the secondary note register 140. The fundamental note register 135 and the secondary note register 140 respectively retain a digital code representing the frequency of the selected the fundamental note and the secondary note. The fundamental note register 135 is connected to the fundamental note harmonic generator 145. In some embodiments, the fundamental note harmonic generator 145 is a digital multiplier that multiplies the code for the frequency of the fundamental note by a set of digits from 2 to an upper range of the harmonics (i.e. 6 or 7) to generate the fundamental harmonic codes 155.

Similarly, the secondary note register 140 is connected to the secondary note harmonic generator 150. In some embodiments, the second note harmonic generator 150 is a digital multiplier that multiplies the code for the frequency of the second note by the set of digits from 2 to an upper range of the harmonics (i.e. 6 or 7) to generate the secondary harmonic codes 160.

The fundamental harmonic codes 155 and the secondary harmonic codes 160 are transferred to the beat time calculator 165. The beat time calculator 165 additively and subtractively combines the fundamental harmonic codes 155 and the secondary harmonic codes 160 to generate the set of beat time codes 170 for all the combinations of the harmonics of the fundamental note and the secondary note. In various embodiments, the beat time codes 170*a* are transferred to the control/display panel 100 for display and selection by a user. A user selects a desired beat time and a beat time select signal 190 is transferred to the beat time selector 175 for selecting the beat time.

In other embodiments, the beat time codes 170*b* are transferred to the beat time selector and the desired time frequency is chosen automatically based on the parameters such as the ability for a user to discriminate the beats and determine if the beat time of the fundamental note and the secondary note of the piano are equal to the generated beat time template. The selected beat time code is transferred to a digital-to-analog converter 195 that converts the selected beat time code to an analog signal that is applied to a speaker 200.

In some embodiments, it is desirable for the user to be able to have reference beat signals such a 60 beats per minute, 120 beats per minute, or 240 beats per minute to become attuned to these beat patterns to distinguish the beat times of the fundamental note and the secondary note from the piano to establish the desired beat time for generation by the beat time template generator. The display panel 100 has 60 beats per minute, 120 beats per minute, and 240 beats per minute selectors. The selectors generate 60 beats per minute, 120 beats per minute, or 240 beats per minute selector signals 180*a*, 180*b*, and 180*c* that are applied to a beat register 185. The beat register 185 stores the necessary beat codes for the 60 beats per minute, 120 beats per minute, and 240 beats per minute signals. The selected code is applied to the digital-to-analog converter 195 that converts the selected beat time code as the beat time template signal to an analog signal that is applied to a speaker 200.

Figure 7:
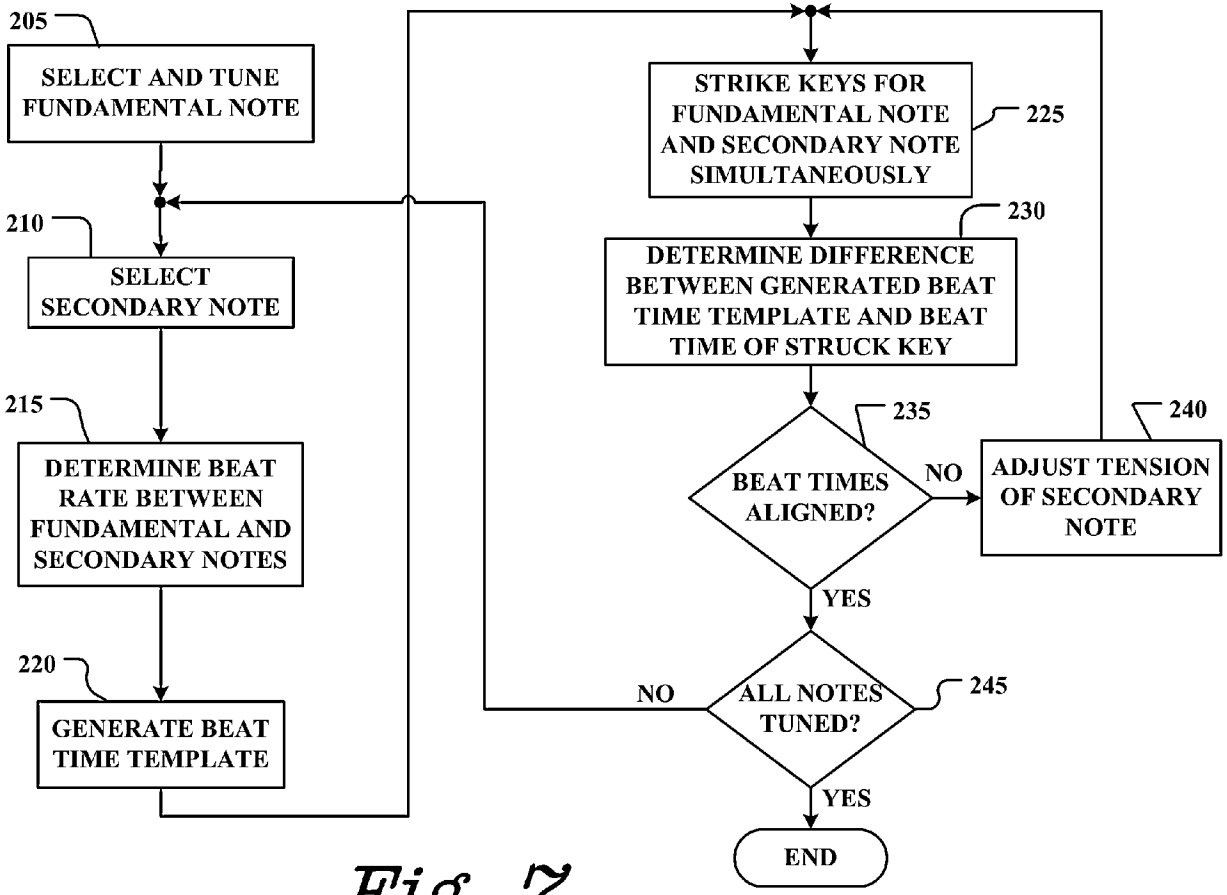
FIG. 7 is a flowchart of a method for tuning a piano embodying the principles of this disclosure.

FIG. 7 is a flowchart of a method for tuning a piano embodying the principles of this disclosure. The method begins with selecting and tuning (Box 205) a fundamental note on the piano. In most embodiments, a tuning fork for the fundamental note is used as an aid to adjust the fundamental note. For example, if the fundamental note is the fourth "A" Key ($A_4$), the tuning fork will provide a frequency of 440 Hz and the $A_4$ key will be adjusted to produce the 440 Hz. A secondary note will then be selected (Box 210) and the desired beat rate between the fundamental note and the secondary note will be determined (Box 215). As described above in FIG. 6, a beat time template generator may determine all the possible beat frequencies and the user may select the appropriated beat time. Alternately, the beat time template generator will choose the beat time based on the parameters of ease of discrimination and ability to match the adjustment of the secondary note to match the beat time of the beat time template generator. The selected beat time is then generated (Box 220).

The fundamental note and the secondary note are struck simultaneously (Box 225) and the user determines (Box 230.) the difference between the generated beat time template and the beat time of the fundamental note and the secondary note of the struck keys. The user further determines (Box 235) whether the beat times are aligned. If they are not aligned, the user adjusts (Box 240) the tension of the string of the secondary note.

The user then strikes (Box 225) the fundamental note and the secondary note simultaneously and the user determines (Box 230.) the difference between the generated beat time template and the beat time of the struck fundamental notes and the secondary note of the struck keys. The user further determines (Box 235) whether the beats are aligned. If they are not aligned, the user adjusts (Box 240) the tension of the string of the secondary note and repeats the process. If the beat time of the struck fundamental note and the secondary is aligned with the beat time template of the beat time template generator, the user determines (Box 245) if all the notes are tuned. If all the notes of the piano are not tuned, the next secondary note is selected (Box 210), the beat time is determined (Box 215), and the beat time template is generated (Box 220). The user strikes (Box 225) the keys of the fundamental note and the secondary note and determines (Box 230) any difference between the beat time of the struck keys and the beat time template of the beat time template generator. The user then determines (Box 235) if the beats are aligned. If the beats are not aligned the user adjusts (Box 240) the tension of the selected key. This is repeated until the beat times are aligned and all the keys have been tuned and the process is ended.

The structure of the beat time template generator as shown is FIG. 6 is functional. The beat time template generator may be a computer-based system with the computer performing the functions of the described elements. The fundamental note register 135 maintains the frequency of the fundamental note and the secondary note register 140 maintains the frequencies of remaining notes. Alternately, the frequencies of the remaining notes may be calculated using the equation detailed above and stored in the secondary note register 140. If the piano is structured for tuning in other temperament structures rather than twelve keys per octave, the equation for the tuning frequencies will be calculated based on that structure.

The computer processor may be programmed to function as the fundamental harmonic generator 145 and the secondary harmonic generator 150. The processor then calculates the beat frequencies for all the harmonics of the fundamental note and the secondary note to perform the function of the beat time calculator 165. The computer processor may be programmed with the necessary parameter to determine the desired beat time as performed by the beat time template. Many modern computer systems have a digital-to-analog converter 195 included in the structure for the conversion of the beat time template to an analog signal for application to an included speaker 200.

While this disclosure has been particularly shown and described with reference to the preferred embodiments thereof, it will be understood by those skilled in the art that various changes in form and details may be made without departing from the spirit and scope of the disclosure.

What is claimed is:

1. A beat time template generating device for determining and providing a beat time template of a fundamental key and a secondary key comprising:

means for calculating all harmonics for the fundamental key;

means for calculating all harmonics for the secondary key;

means for determining difference a plurality of beat frequencies for all the harmonics calculated for the fundamental key and secondary key;

means for selecting one beat time as a reference beat time template signal from the plurality of beat frequencies; and means for transferring the reference beat time template signal to a speaker for reproduction.

2. The beat time template generating device of claim 1 wherein a piano tuner tunes a piano with the beat time template generating device by:

tuning the fundamental key to an assigned frequency;

selecting a secondary key of the piano for tuning;

informing the beat time template generating device of the fundamental key and the secondary key;

activating the beat time template generating device to provide a selected beat time template of the fundamental key and the secondary key; and adjusting the strings of the secondary key such that when the fundamental key and the secondary key are struck simultaneously, the beat time of the struck keys is identical to the reference beat time template signal from the beat time template generating device.

3. A method for tuning a piano comprising the steps of tuning a fundamental key to an assigned frequency;

selecting a secondary key of the piano for tuning;

informing a beat time template generating device of the fundamental key and the secondary key;

providing a selected beat time template of the fundamental key and the secondary key with the beat time template generating device, wherein providing the selected beat time comprises:

calculating all harmonics for the fundamental key, calculating all harmonics for the secondary key, determining difference a plurality of beat frequencies for all the harmonics calculated for the fundamental key and secondary key, selecting one beat item as a reference beat time template signal from the plurality of beat frequencies, and transferring the reference beat time template signal to a speaker for reproduction; and adjusting the strings of the secondary key such that when the fundamental key and the secondary key are struck simultaneously, the beat time of the struck keys is identical to the reference beat signal from the beat time template generating device.

4. The method of claim 3 wherein the beat time template generating device comprises:

a control interface device comprising:

a fundamental note selector for indicating which note of the piano is tuned to an accurate pitch or frequency, and a secondary note selector for indicating the note of the piano that is to be tuned relative to the fundamental note;

a fundamental note register to receive and retain a digital code indicative of the frequency or pitch of the fundamental note a secondary note register to receive and retain a digital code indicative of the frequency or pitch of the secondary note;

a fundamental note harmonic generator connected to the fundamental note register to receive digital code of the fundamental note and to generate a set of digital codes indicative of a set of the harmonics of the frequency of the fundamental note;

a secondary note harmonic generator connected to the secondary note register to receive the digital code of the secondary note and to generate a set of digital codes indicative of a set of the harmonics of the frequency of the secondary note;

a beat time calculator connected to receive the harmonic codes for the fundamental note and the harmonic codes for the secondary note to determine all the combinations of beat frequencies as a difference between the fundamental note and its harmonics and the secondary note and its harmonics to generate a set of all the beat frequency codes; and a beat time selector connected to the beat time calculator to receive the beat frequency codes to chose one beat time for reproduction as the reference beat time template signal.

5. The method for tuning a piano of claim 4 wherein the beat time template generating device further comprises:

a digital-to-analog converter connected to the beat time selector to receive the digital code representing the selected beat time between the fundamental note and the secondary note to an analog signal representing the reference beat time template signal; and a speaker connected to the digital-to-analog converter to receive the analog signal for reproducing of the reference beat time template signal as sound.

6. The method for tuning a piano of claim 5 further comprising detecting a difference between the beat time of the simultaneously struck fundamental note and the secondary note and the reproduced reference beat time template signal from the speaker of the beat time template generating device.

7. The method for tuning a piano of claim 3 wherein tuning the fundamental key comprises adjusting the strings of the fundamental note to the "A" key above middle "C" or "$A_4$" to be 440 Hz.

8. The method for tuning a piano of claim 3 wherein the calculating all harmonics for the fundamental key and calculating all harmonics for the secondary key each comprise determining six harmonics for the fundamental note and the secondary note.

9. The method for tuning a piano of claim 3 wherein selecting one time frequency comprises choosing the beat time automatically.

10. The method for tuning a piano of claim 3 wherein selecting one beat time comprises the user selecting one beat time from the plurality of beat frequencies.

11. The method for tuning a piano of claim 4 wherein the control interface device is a display coupled with a keyboard, a touch sensitive display, or a panel including indicator lights and switches.

12. A beat time template generating device for tuning a piano to equal temperament comprises:

a control interface device comprising:

a fundamental note selector for indicating which note of the piano is tuned to an accurate pitch or frequency, and a secondary note selector for indicating the note of the piano that is to be tuned relative to the fundamental note;

a fundamental note register to receive and retain a digital code indicative of the frequency or pitch of the fundamental note a secondary note register to receive and retain a digital code indicative of the frequency or pitch of the secondary note;

a fundamental note harmonic generator connected to the fundamental note register to receive digital code of the fundamental note and to generate a set of digital codes indicative of a set of the harmonics of the frequency of the fundamental note;

a secondary note harmonic generator connected to the secondary note register to receive the digital code of the secondary note and to generate a set of digital codes indicative of a set of the harmonics of the frequency of the secondary note;

a beat time calculator connected to receive the harmonic codes for the fundamental note and the harmonic codes for the secondary note to determine all the combinations of beat frequencies as a difference between the fundamental note and its harmonics and the secondary note and its harmonics to generate a set of all the beat frequency codes; and a beat time selector connected to the beat time calculator to receive the beat frequency codes to chose one beat time as a reference beat time template signal for reproduction.

13. The beat time template generating device of claim 12 further comprising:

a digital-to-analog converter connected to the beat time selector to receive the digital code representing the selected beat time between the fundamental note and the secondary note to an analog signal representing the reference beat time template signal; and a speaker connected to the digital-to-analog converter to receive the analog signal for reproducing of the reference beat time template signal as sound.

14. The beat time template generating device of claim 13 wherein in tuning a piano, a difference between the beat time of the simultaneously struck fundamental note and the secondary note and the reproduced reference beat time template signal from the speaker of the beat time template generating device is detected.

15. The beat time template generating device of claim 12 wherein in tuning the fundamental key, the strings of the fundamental note are adjusted to the "A" key above middle "C" or "$A_4$" to be 440 Hz.

16. The beat time template generating device of claim 12 wherein the fundamental note harmonic generator and secondary note harmonic generator each determine six harmonics for the fundamental note and the secondary note.

17. The beat time template generating device of claim 12 wherein the beat time selector chooses the reference beat time template signal automatically.

18. The beat time template generating device of claim 12 wherein the user provides a selection input to indicate a desired reference beat time template signal from the plurality of beat frequencies to the beat time selector.

19. The beat time template generating device of claim 12 wherein the control interface device is a display coupled with a keyboard, a touch sensitive display, or a panel including indicator lights and switches.

* * * * *